US009074535B1

(12) United States Patent
Huibregtse et al.

(10) Patent No.: US 9,074,535 B1
(45) Date of Patent: Jul. 7, 2015

(54) INTEGRATED ENGINE CONTROL APPARATUS AND METHOD OF OPERATING SAME

(71) Applicant: Kohler Co., Kohler, WI (US)

(72) Inventors: Mark J. Huibregtse, New Holstein, WI (US); Gary L. Stenz, Mt. Calvary, WI (US); Eric C. Simon, Green Bay, WI (US)

(73) Assignee: Kohler Co., Kohler, WI (US)

( * ) Notice: Subject to any disclaimer, the term of this patent is extended or adjusted under 35 U.S.C. 154(b) by 14 days.

(21) Appl. No.: 14/134,870

(22) Filed: Dec. 19, 2013

(51) Int. Cl.

| | |
|---|---|
| ***F02D 9/02*** | (2006.01) |
| ***F02M 1/08*** | (2006.01) |
| ***F02M 3/06*** | (2006.01) |
| ***F02M 3/08*** | (2006.01) |

(52) U.S. Cl.

CPC ..... *F02D 9/02* (2013.01); *F02D 2009/0205* (2013.01); *F02D 2009/0208* (2013.01); *F02D 2009/0245* (2013.01); *F02D 2009/0203* (2013.01); *F02M 3/06* (2013.01); *F02M 3/08* (2013.01)

(58) Field of Classification Search

CPC ..... F02D 9/02; F02M 1/08; F02M 3/06; F02M 3/08

USPC ..... 123/339.1, 339.13, 330, 363, 376, 403, 123/198 R; 74/501.6, 504, 523, 526; 261/34.1, 38, 52, 64.1, 64.6, 71

See application file for complete search history.

(56) References Cited

U.S. PATENT DOCUMENTS

| | | | |
|---|---|---|---|
| 262,632 | A | 8/1882 | Whittaker |
| 2,908,263 | A | 10/1959 | Brown |
| 3,376,890 | A | 4/1968 | Hanson et al. |
| 3,390,921 | A | 7/1968 | Klimek |

(Continued)

FOREIGN PATENT DOCUMENTS

| | | | |
|---|---|---|---|
| DE | 4120876 | A1 | 12/1992 |
| EP | 2112355 | | 10/2009 |
| JP | 2000220478 | A | 8/2000 |

OTHER PUBLICATIONS

Kohler Co., Kohler Command Pro CH260-CH440 Service Manual, 2011, http://www.kohlerengines.com/onlinecatalog/pdf/sm_17_690_01.pdf; 72 pages.

(Continued)

*Primary Examiner* — Lindsay Low
*Assistant Examiner* — Grant Moubry
(74) *Attorney, Agent, or Firm* — Whyte Hirschboeck Dudek S.C.

(57) ABSTRACT

Engine control assemblies for use with internal combustion engines, engines having such assemblies, and methods for operating such engines and assemblies are disclosed. In one example embodiment of an engine control assembly encompassed herein, the assembly includes a lever structure configured to rotate to any of a plurality of positions ranging from a first position to a second position. The assembly also includes at least one linking structure configured to allow rotational movement of the lever structure to influence at least indirectly an engine choking operation, where the at least one linking structure including a rod that includes a bend portion along its length, and the lever structure includes a formation with an orifice through which the rod extends. The rod and formation are configured so that at least some other rotational movement of the lever structure does not cause any corresponding movement of the choke actuation input structure.

20 Claims, 4 Drawing Sheets

(56) References Cited

U.S. PATENT DOCUMENTS

| | | | | |
|---|---|---|---|---|
| 3,626,919 | A | 12/1971 | MacMillan | |
| 3,749,069 | A | 7/1973 | Reese | |
| 3,823,700 | A | 7/1974 | Gumtow | |
| 3,847,034 | A | 11/1974 | Hemens | |
| 4,079,708 | A | 3/1978 | Wieland et al. | |
| 4,254,064 | A | 3/1981 | Bernauer et al. | |
| 4,457,271 | A | 7/1984 | Fitch | |
| 4,490,309 | A | 12/1984 | Fujikawa et al. | |
| 4,510,739 | A | 4/1985 | Dluhosch | |
| 4,517,942 | A | 5/1985 | Pirkey et al. | |
| 4,631,153 | A | 12/1986 | Tamba et al. | |
| 4,773,371 | A | 9/1988 | Stenz | |
| 4,860,608 | A | 8/1989 | Kobayashi | |
| 4,903,670 | A | 2/1990 | Bauder | |
| 5,092,295 | A | 3/1992 | Kobayashi | |
| 5,163,401 | A | 11/1992 | Reese | |
| 5,174,255 | A | 12/1992 | Collins et al. | |
| 5,203,302 | A | 4/1993 | Parnitzke | |
| 5,211,144 | A | 5/1993 | Collins et al. | |
| 5,215,049 | A | 6/1993 | Wolf | |
| 5,301,644 | A | 4/1994 | Olmr | |
| 5,581,986 | A | 12/1996 | Calver | |
| 6,082,323 | A | 7/2000 | Winberg | |
| 6,134,984 | A * | 10/2000 | Hisadomi | 74/502.2 |
| 6,145,487 | A * | 11/2000 | Dykstra et al. | 123/179.18 |
| 6,202,989 | B1 | 3/2001 | Pattullo | |
| 6,213,083 | B1 | 4/2001 | Winberg | |
| 6,419,420 | B2 | 7/2002 | Hedlund | |
| 6,439,547 | B1 | 8/2002 | King et al. | |
| 6,454,245 | B2 | 9/2002 | Kobayashi | |
| 6,481,415 | B1 | 11/2002 | Cook | |
| 6,550,749 | B2 | 4/2003 | Vick | |
| 6,598,586 | B2 | 7/2003 | Deschamps et al. | |
| 6,691,683 | B2 | 2/2004 | Gracyalny et al. | |
| 6,698,397 | B2 | 3/2004 | Cook | |
| 6,729,298 | B1 | 5/2004 | Sterr | |
| 6,761,145 | B2 | 7/2004 | Matsuda et al. | |
| 6,855,091 | B1 | 2/2005 | Holmes | |
| 6,857,410 | B2 | 2/2005 | Davis et al. | |
| 6,871,623 | B2 * | 3/2005 | Ohsawa et al. | 123/179.18 |
| 6,986,340 | B2 | 1/2006 | Gracyalny et al. | |
| 7,069,915 | B2 | 7/2006 | Brandenburg et al. | |
| 7,097,163 | B2 | 8/2006 | Moriyama et al. | |
| 7,104,258 | B2 | 9/2006 | Yamada et al. | |
| 7,118,097 | B2 | 10/2006 | Moriyama et al. | |
| 7,146,962 | B2 | 12/2006 | Sugimoto et al. | |
| 7,152,580 | B2 | 12/2006 | Wetor et al. | |
| 7,165,532 | B2 | 1/2007 | Steffes et al. | |
| 7,231,900 | B1 | 6/2007 | Hanshaw | |
| 7,263,981 | B2 | 9/2007 | Woody | |
| 7,344,125 | B2 * | 3/2008 | Matsuda et al. | 261/64.1 |
| 7,404,546 | B2 | 7/2008 | Prager et al. | |
| 7,424,884 | B2 | 9/2008 | Woody | |
| 7,568,472 | B2 | 8/2009 | Woody | |
| 7,950,366 | B2 | 5/2011 | Arai et al. | |
| 8,240,639 | B2 | 8/2012 | Roth | |
| 8,408,183 | B2 | 4/2013 | Johnson | |
| 8,408,525 | B2 * | 4/2013 | Grater et al. | 261/47 |
| 8,511,650 | B2 * | 8/2013 | Kern et al. | 261/52 |
| 8,567,371 | B2 * | 10/2013 | Vaughn et al. | 123/376 |
| 2009/0260596 | A1 | 10/2009 | Johnson | |
| 2011/0114055 | A1 | 5/2011 | Naegele et al. | |
| 2011/0226217 | A1 | 9/2011 | Raasch | |

OTHER PUBLICATIONS

U.S. Appl. No. 13/897,899, filed May 20, 2013 with the United States Patent & Trademark Office entitled "Automatic Fuel Shutoff"; 40 pages.

Partial European Search Report for EP Application No. 14190912 dated May 18, 2015, 7 pages.

* cited by examiner

INTEGRATED ENGINE CONTROL APPARATUS AND METHOD OF OPERATING SAME

CROSS-REFERENCE TO RELATED APPLICATIONS

1. Field of the Invention

The present invention relates to control mechanisms for internal combustion engines, particularly control mechanisms that are employed to govern operation of engine components such as throttle, choke, on/off switch, and/or other engine component(s).

2. Background of the Invention

Internal combustion engines are used in a wide variety of applications including, for example, automobiles, lawnmowers, tractors, snow blowers, power machinery, and boating/marine applications, among others. Many such internal combustion engines employ a carburetor with a throttle and a choke that provide a proper fuel/air mixture to the engine cylinder(s). Additionally, many such engines employing carburetors further employ control mechanisms by which operations of the throttle and/or choke (and thus operation of the carburetor) are controlled, which in turn influences engine speed and power output. Often, the control mechanisms operate at least in part in response to centrifugal governor mechanisms, which provide input forces that depend upon engine speed (and engine load) and thus serve as feedback mechanisms. The choke mechanisms of such engines typically are used to aid in the starting of the engines by adjusting the air/fuel mixture.

A variety of different types of engine control mechanisms have been developed for use in various applications. Notwithstanding the availability of these various conventional types of engine control mechanisms, there continues to be a need for enhancements in the designs of such mechanisms in various respects. Among other things, many conventional engine control mechanisms can be difficult for an operator to operate due to difficulties or complexities associated with actuating the control inputs, and there particularly continues to be a need for improved engine control mechanisms that facilitate user actuation of engine components such as throttle and/or choke components. For at least the above reasons, it would be advantageous if an improved engine control assembly could be developed that had one or more enhanced features and/or achieved enhanced performance in regard to one or more of the above-described considerations or other considerations.

BRIEF SUMMARY OF THE INVENTION

In at least some embodiments, the present invention relates to an engine control assembly for use with an internal combustion engine. The engine control assembly includes a mounting structure and a first lever structure that is coupled to the mounting structure and configured to rotate about a first axis to any of a plurality of positions ranging from a first position to a second position in response to input forces being applied thereto. The engine control assembly also includes a switch device positioned in relation to the first lever structure, the switch device configured to cause the engine to stop running when the first lever structure is in the first position so as to impart a further force at least indirectly to an input of the switch device. Further, the engine control assembly includes at least one first linking structure coupled to the first lever structure and configured to allow first rotational movement of the first lever structure to influence at least indirectly an engine throttle operation, and at least one second linking structure coupled to the first lever structure and configured to allow second rotational movement of the first lever structure to influence at least indirectly an engine choking operation, where the engine choking operation occurs at least when the first lever structure is at the second position. The at least one second linking structure includes a rod that extends between the first lever structure and a choke actuation input structure, the rod includes at least one bend portion along a length of the rod, and the at least one portion of the first lever structure includes a formation with an orifice through which the rod extends. The formation is in contact with the at least one bend portion when the first lever structure undergoes the second rotational movement, so that at least some substantially linear movement is imparted to the rod that in turn causes at least some associated movement of the choke actuation input structure resulting in the engine choking operation, and the rod and the formation are configured so that the first rotational movement of the first lever structure does not cause any corresponding movement of the choke actuation input structure.

Further, in at least some embodiments, the present invention relates to an engine control assembly for use with an internal combustion engine. The engine control assembly includes a mounting structure, and a first lever that is configured to receive input forces at least indirectly received from an operator and capable of attaining a range of positions including and between a first position and a second position. Additionally, the engine control assembly includes a second lever, a third lever that is at least indirectly linked to a throttle actuation input structure, and at least one linkage coupling the first lever to a choke actuation input structure. The first lever is rotatably coupled to the mounting structure, and the second lever is at least indirectly coupled to each of the first lever and the third lever. Further, the engine control assembly is configured so that first movements of the first lever between the first position and an intermediate position between the first and second positions in response to the input forces can at least indirectly affect the throttle actuation input structure. Also, the at least one linkage is configured so that the first movements of the first lever do not affect a positioning of the choke actuation input structure but second movements of the first lever between the intermediate position and the second position do affect the positioning of the choke actuation input structure, and the at least one linkage includes a rod having at least one bend portion along a length of the rod, where the first lever includes a formation with an orifice through which the rod extends, and where the formation is in contact with the at least one bend portion when the first lever undergoes the second movements, so that at least some substantially linear movement is imparted to the rod that in turn causes at least one associated movement of the choke actuation input structure resulting in an engine choking operation.

Additionally, the present invention in at least some embodiments relates to a method of operating an internal combustion engine. The method includes providing an engine control assembly including a first lever structure, a mounting structure, and at least one link structure at least indirectly coupling the first lever structure to a choke actuation input structure, the first lever structure being rotatably coupled to the mounting structure and configured for attaining any of a plurality of positions including and between a first position and a second position. The method further includes first rotating the first lever structure at least from an intermediate position between the first and second positions to the second position, where the first rotating results in an actuation force being communicated from the first lever structure to the choke actuation input structure by way of the at least one link structure so that, upon the first lever structure reaching the second position, a choke of the engine is in a substantially closed position, and second rotating the first lever structure back from the second position to a further position that is either at the intermediate position or in between the intermediate position and the first position so that a choking operation of the engine substantially ceases. The method also includes operating the engine at a throttle setting determined at least in part by the further position of the first lever structure, and third rotating the first lever structure to the first position so that, at least indirectly, a force is communicated from the first lever structure to an input of a switching device and, as a result, the engine is switched to an off status. The at least one link structure includes a rod with a bend portion and the first lever structure includes a formation with an orifice through which the rod extends, where during the first rotating the formation imparts the actuation force upon the bend portion and the actuation force in turn is communicated to the choke actuation input structure by way of the rod, and where during a rotational movement of the first lever structure between the intermediate and first positions, the formation is no longer in contact with the bend portion and correspondingly the rotational movement of the first lever structure between the intermediate and first positions has no effect on the choking operation of the engine.

BRIEF DESCRIPTION OF THE DRAWINGS

Embodiments of the invention are disclosed with reference to the accompanying drawings. It should be understood that the embodiments shown in the drawings are provided for illustrative purposes only, and that the present invention is not limited in its application or scope to the details of construction or the arrangements of components particularly illustrated in these drawings.

DETAILED DESCRIPTION OF THE INVENTION

Figure 1:
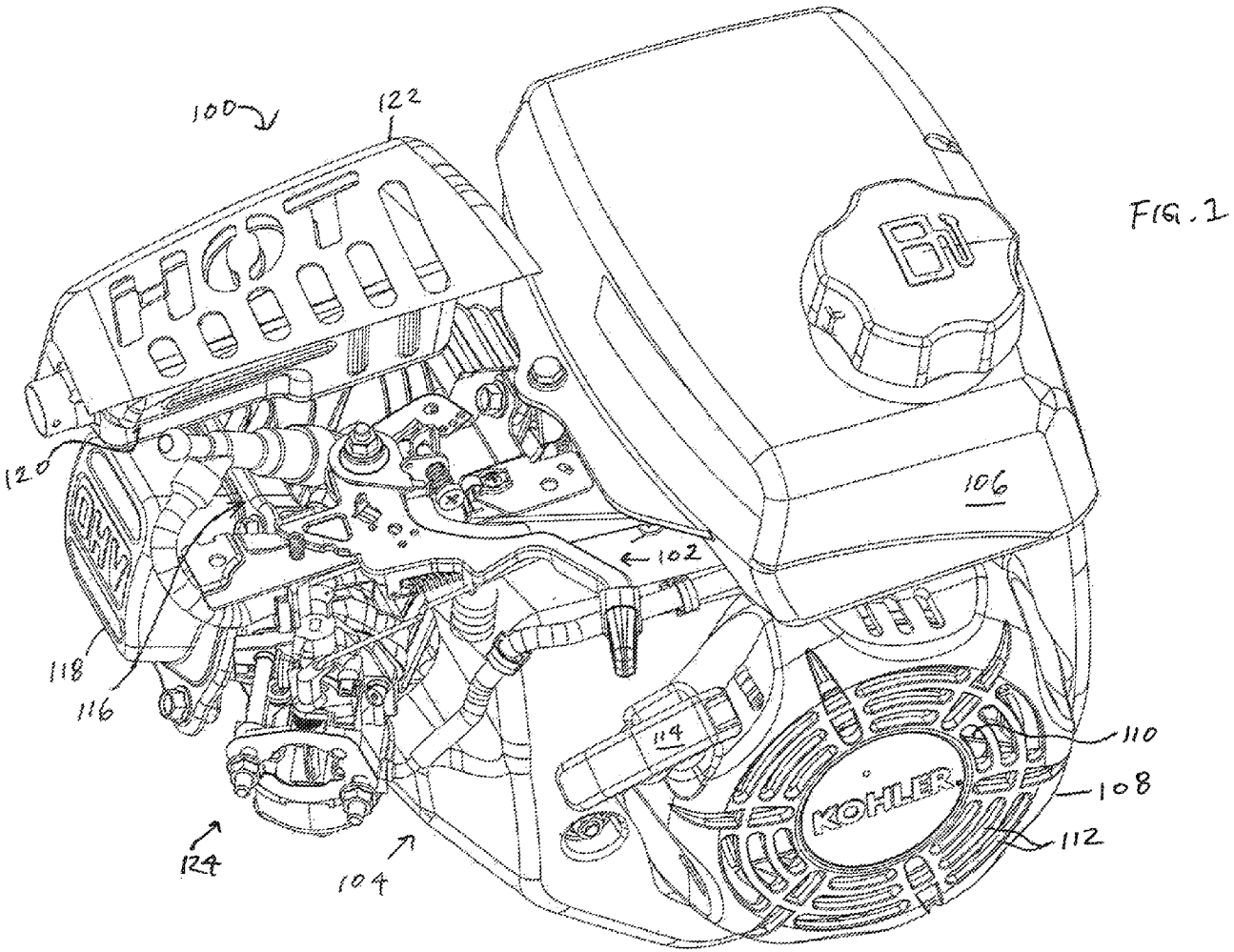
FIG. 1 is a front top perspective view of portions of an exemplary internal combustion engine including portions of an exemplary engine control assembly positioned in an off position, in accordance with at least some embodiments of the present invention.
Figure 2:
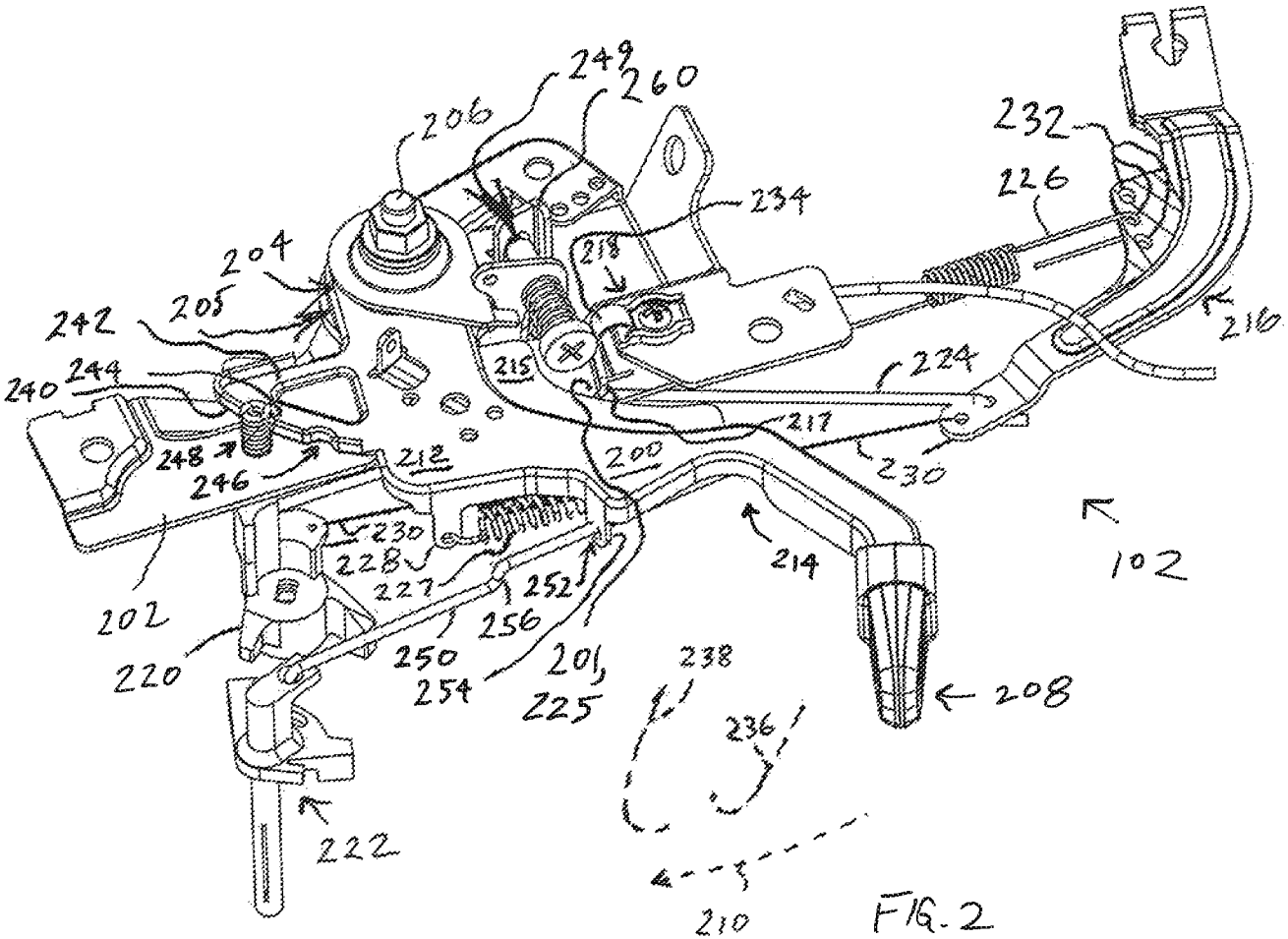
FIG. 2 is an additional front top perspective view of the same exemplary engine control assembly positioned in the same off position as shown in FIG. 1, with other portions of the engine no longer being shown.
Figure 3:
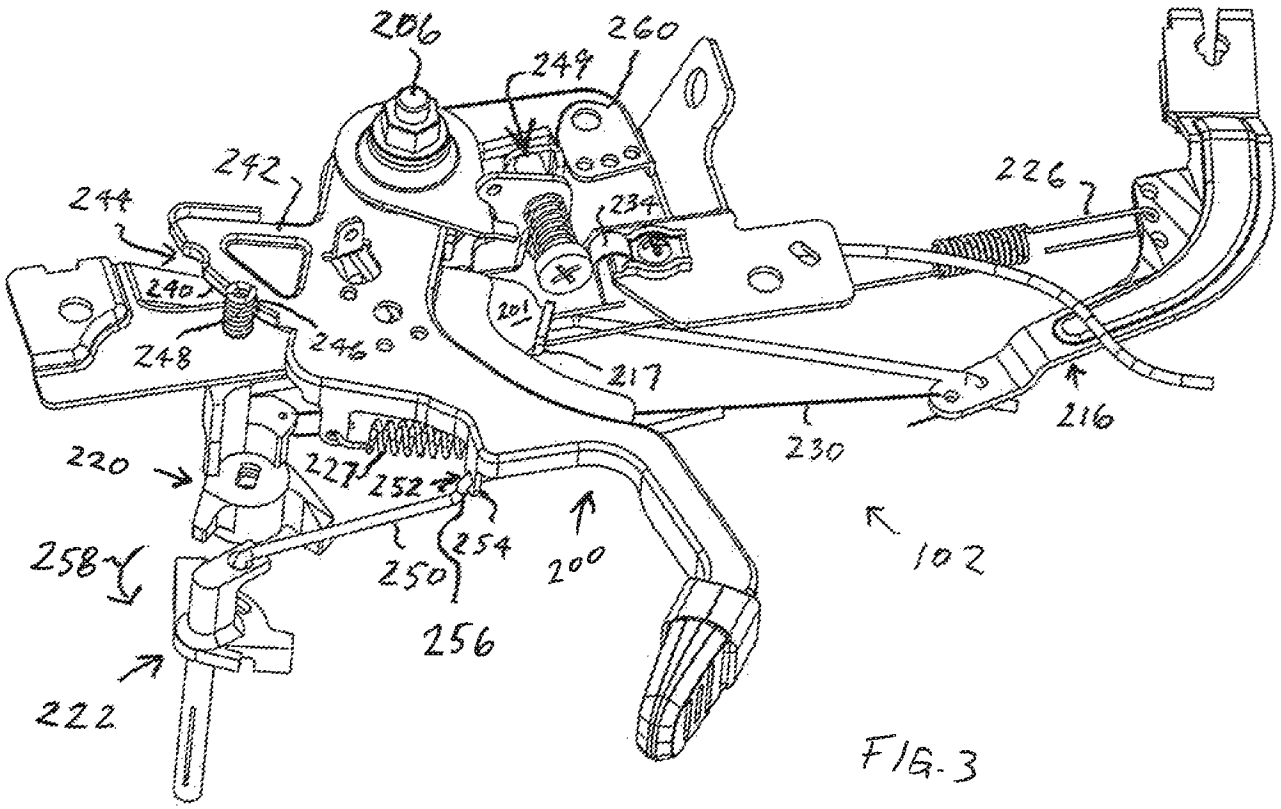
FIG. 3 is an additional front top perspective view of the same exemplary engine control assembly shown in FIG. 2, except that the engine control assembly is now positioned in a high-speed position.
Figure 4:
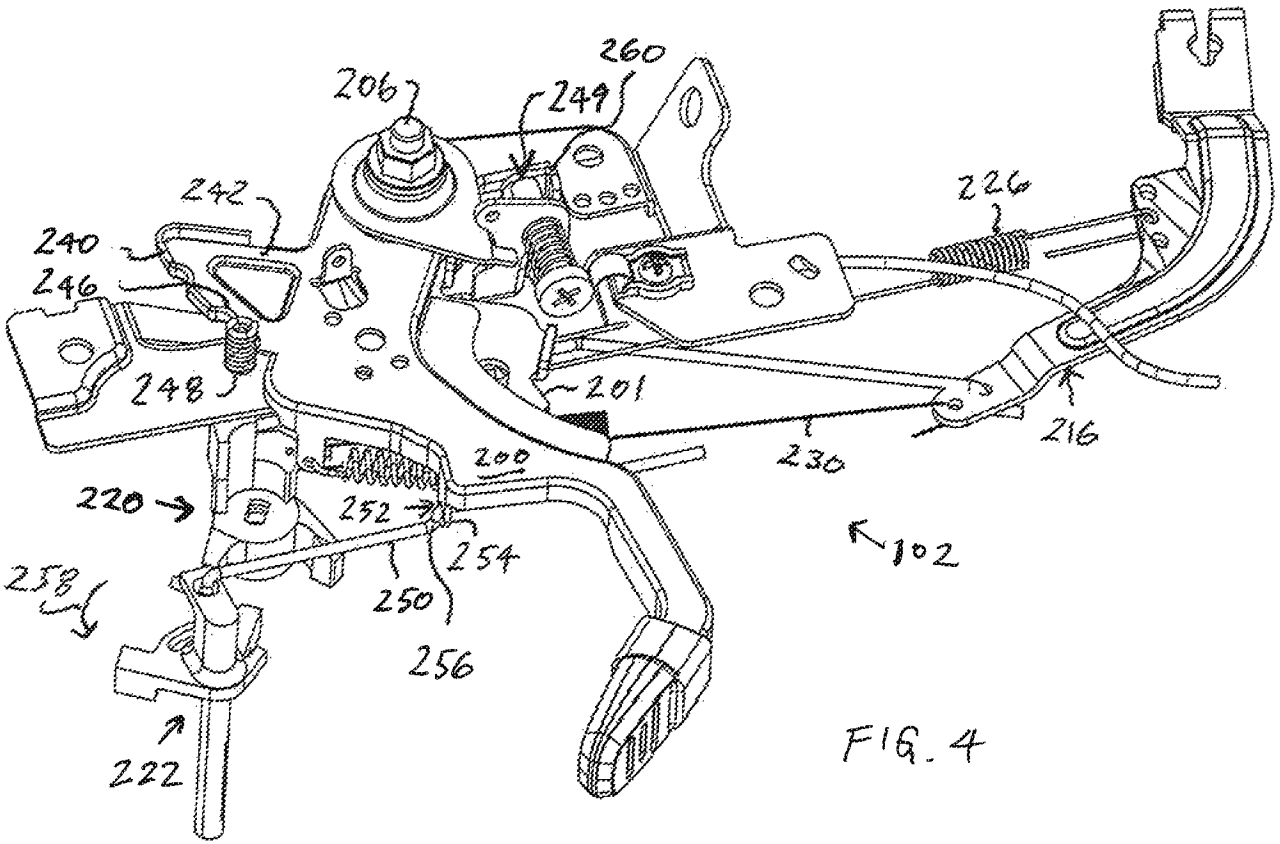
FIG. 4 is an additional front top perspective view of the same exemplary engine control assembly shown in FIGS. 2 and 3, except that the engine control assembly is now positioned in a choke position.

Referring to FIG. 1, a front top perspective view is provided to show portions of an exemplary internal combustion engine 100 having an engine control assembly 102 that is further shown also in FIGS. 2, 3, and 4. In the present embodiment, the engine 100 is a single-cylinder horizontal crankshaft engine that is suitable for implementation in a variety of applications including, for example, lawnmowers, snow blowers, and power machinery. As shown, in the present embodiment, the engine 100 includes a crankcase 104, upon which is positioned a fuel tank 106. Also as shown, a fan cover 108 is mounted along a front side of the crankcase 104. The fan cover 108 surrounds and covers over a fan 110, which is slightly visible through louvers 112 formed on the fan cover. A handle 114 of a recoil starter (not shown) is also positioned generally to one side of the fan cover 108 is also visible in FIG. 1.

It will be appreciated that a crankshaft within the engine 100 extends horizontally within the engine generally in a front-to-rear direction along an axis coinciding with a central axis of the fan 110. Additionally as shown, a cylinder 116 extends diagonally upward and outward away from the crankcase 104 and particularly away from the horizontal crankshaft extending within the crankcase (with the cylinder axis being generally perpendicular to the crankshaft axis), and a valve cover 118 is positioned at a cylinder head of the cylinder 116 at a location outward away from the crankcase. Also, a muffler 120 with a cover or shield 122 is positioned above the cylinder 116, adjacent to the fuel tank 106. Finally, further as shown, the engine 100 includes a carburetor 124 that is positioned forward of the cylinder 116. As described further below, the engine control assembly 102 particularly is operable to control actuation of a throttle and a choke associated with the carburetor 124.

Referring additionally to FIG. 2, the engine control assembly 102 is shown apart from the remainder of the engine 100 so as to highlight features of the engine control assembly. More particularly as shown, the engine control assembly 102 includes a manually-operable operator control lever (hereinafter referred to as a human interface lever) 200, an intermediate lever 201, and a mounting bracket (or base platform bracket) 202. Each of a first end 204 of the human interface lever 200 and a first end 205 of the intermediate lever 201 is rotatably coupled to the mounting bracket 202 by way of a bolt (or, in alternate embodiments, one or more other fastener(s)) 206, such that both the human interface lever and the intermediate lever are rotatable particularly about a common axis of rotation coinciding with a central axis of the bolt. In the present embodiment, the intermediate lever 201 is sandwiched between the human interface lever 200 and the mounting bracket 202, although in other embodiments the human interface lever can be positioned between the mounting bracket and the intermediate lever (which in such embodiments can be referred to as a top lever or by some other name).

Further as shown, a second end 208 of the human interface lever 200 is the portion of that lever that can be pushed by an operator to achieve rotation of the human interface lever about the central axis of the bolt 206 in a direction indicated by an arrow 210 (and also in the opposite direction, depending upon the current position of the human interface lever). In the present embodiment, the human interface lever 200 is generally S-shaped as it extends from the first end 204 to the second end 208. By virtue of this S-shaped configuration, between the first end 204 and second 208, the human interface lever 200 includes a first curved portion 212 closer to the first end 204 than to the second end 208 and also includes a second curved portion 214 closer to the second end than to the first end. The second curved portion 214 has its concave side facing in the direction indicated by the arrow 210, and the first curved portion 212 by contrast has its concave side facing in substantially the opposite direction. Further, the human interface lever 200 also includes a lip 215 extending inwardly of the first curved portion 212 (that is, inwardly from the concave edge of the first curved portion 212). The lip 215 in at least some operational circumstances comes into contact with an upwardly-directed tab 217 of the intermediate lever 201 as shown in FIG. 2.

In addition to the human interface lever 200, the intermediate lever 201, and the mounting bracket 202, the engine control assembly 102 further includes a governor lever (or arm) 216, a kill switch 218, a throttle actuation input 220, and a choke actuation input 222. Although not shown in FIG. 2, the governor lever 216 is pivotally mounted in relation to the engine 100 so as to rotate about an axis that is fixed relative to the mounting bracket 202 (and, in some embodiments, the governor lever is rotatably coupled directly to the mounting bracket 202 in the same or substantially the same manner as the human interface lever 200 is rotatably coupled to the mounting bracket). Movement of the governor lever 216 is determined by several components that act upon the governor lever. First, although not visible in FIG. 1 or 2, it should be appreciated that the engine 100 includes a centrifugal governor, and that the governor lever 216 is coupled to the centrifugal governor by way of a governor rod 224. The centrifugal governor is configured to apply pressure so as to move the governor rod 224 and correspondingly move the governor lever 216 in a manner that depends upon engine speed.

Additionally, in the present embodiment, the governor lever 216 also is coupled to a second end 225 of the intermediate lever 201 by way of a governor spring 226. By virtue of an additional spring 227 linking a tab 228 on the human interface lever 200 with the intermediate lever 201, rotation of the human interface lever 200 in the direction of the arrow 210 causes movement of the intermediate lever 201 also generally in that same direction. This in turn causes force to be applied to the governor lever 216 by way of the governor spring 226 tending to rotate the governor lever 216 also generally in the direction of the arrow 210 (albeit the governor lever rotates about an axis that is different than the axis about which the intermediate lever 201 and human interface lever 200 rotate). Although not included in the present embodiment, in some alternate embodiments, a further idle spring can also be provided that places tension upon the governor lever 216 under at least some operational circumstances. Further as shown, the governor lever 216 is also coupled to the throttle actuation input 220 by way of a throttle actuation spring link 230. As a result of this connection to the throttle actuation input 220 by way of the throttle actuation spring link 230, different movements of the governor lever 216 can cause both opening and closing of a throttle within the carburetor 124.

It should be appreciated that the particular actuation of the throttle by way of the governor lever 216, governor rod 224 (and centrifugal governor), intermediate lever 201, additional spring 227, governor spring 226, throttle actuation spring link 230, and throttle actuation input 220 can be varied depending upon the embodiment or circumstance. Not only can, in alternate embodiments, the components employed to achieve throttle actuation be varied from those shown in FIG. 2, but also even in a particular embodiment such as that shown in FIG. 2 various operational characteristics can be modified by changing various features of the components or arrangement including, for example, replacing a given one of the aforementioned spring components with another spring component having a different spring constant. Further for example, it will be particularly observed from FIG. 2 that the governor lever 216 includes three orifices 232 by which the governor spring 226 can be attached to the governor lever 216 and therefore, although in the present arrangement the governor spring 226 particularly is attached to the governor lever 216 by way of a middle one of the three orifices, in other arrangements to attain different performance characteristics the governor spring can be coupled to the governor lever by way of the others of those orifices.

In addition to the above-described features involving actuation of the throttle by way of movement of the governor lever 216 and other components described above, FIG. 2 and also FIGS. 3 and 4 also show how the human interface lever 200 both interacts with the kill switch 218 and with the choke actuation input 222, particularly when the position of the human interface lever 200 is rotated among different positions. In this regard, FIG. 2 particularly illustrates the human interface lever 200 (and the intermediate lever 201) as being positioned in an "off" position, which in the present embodiment is the position of the human interface lever when it is moved as much as possible toward the governor lever 216, that is, moved as much as possible contrary to the direction indicated by the arrow 210. When the human interface lever 200 is in the "off" position, the intermediate lever 201 is also moved as much as possible toward the governor lever 216. More particularly, when the human interface lever 200 is in the "off" position, an inner edge of the lip 215 of the human interface lever 200 contacts the upwardly-directed tab 217 of the intermediate lever 201 and that tab in turn is pressed against an actuation tab 234 that serves as the input of the kill switch 218, such that the engine 100 cannot be operating at that time. Relatedly, if the engine 100 previously was operating prior to the tabs 217 and 234 being in contact, the engine ceases operation when the upwardly-directed tab 217 encounters the actuation tab 234, it being understood that the kill switch can operate to prevent or end engine operation in a variety of manners including, for example, by preventing or causing cessation of ignition events at a spark plug of the engine.

In contrast to FIG. 2, FIG. 3 shows the human interface lever 200 when it has been moved to a different "high-speed" (or "full on") position and FIG. 4 additionally shows the human interface lever when it has been moved to a "choke" position. It should be appreciated that the "high-speed" position of the human interface lever 200 is attained when that lever is moved a first extent away from the "off" position and away from the governor lever 216 in the direction indicated by the arrow 210, and additionally that the "choke" position of the human interface lever 200 is attained when that lever is moved a second extent away from the "off" position and away from the governor lever 216 again in the direction indicated by the arrow 210, beyond the "high-speed" position. Although FIGS. 3 and 4 respectively are provided to show the engine control assembly 102 substantially in its entirety when the human interface lever 200 is in the "high-speed" position and "choke" position, respectively, FIG. 2 also includes a first dashed silhouette line 236 and a second dashed silhouette line 238 that are respectively provided to further illustrate the relative positioning of the human interface lever 200 when that lever is in the "high-speed" position and the "choke" position, respectively, additionally in relation to the positioning of the human interface lever when that lever is in the "off" position as is primarily shown in FIG. 2. For clarity, it should be recognized that the first dashed silhouette line 236 generally represents the side of the second end 208 of the human interface lever that is closer to the governor lever 216, and that the second dashed silhouette line 238 generally represents the side of the second end 208 that is farther from the governor lever.

Further as shown by a comparison of FIG. 2 and FIG. 3, when the human interface lever 200 is moved from the "off" position (FIG. 2) to the "high-speed" position (FIG. 3), the intermediate lever 201 also is correspondingly moved in the direction indicated by the arrow 110 of FIG. 2 and away from the governor lever 216 by virtue of the connection provided by the additional spring 227. As a consequence, the upwardly-directed tab 217 of the intermediate lever 201 is no longer in contact with the actuation tab 234 and thus the kill switch 218 no longer is actuated and correspondingly the engine 100 is running or at least is able to continue running upon the engine being started (the engine is "on"). Further, as the human interface lever 200 is moved from the "off" position (FIG. 2) to the "high-speed" position (FIG. 3), tension is applied to the governor lever 216 (again via the additional spring 227, intermediate lever 201, and governor spring 226) and this causes actuation of the throttle via the throttle actuation input 220 and the throttle actuation spring link 230. More particularly, it should be appreciated that, as the human interface lever 200 is moved from the "off" position to the "high-speed" position, the degree to which tension is applied to the governor lever 216 and thus the degree to which the throttle is actuated varies, generally from a minimum level of throttle actuation when the human interface lever is proximate the "off" position, to a maximum level of throttle actuation when the human interface level attains the "high-speed" position.

In the present embodiment, the engine control assembly 102 is configured so that the human interface lever 200 naturally tends to remain in the "off" position when it is already in that position, as well as naturally tends to remain in the "high-speed" position when it is already in that position. More particularly, an edge 240 of a triangular extension 242 of the human interface lever 200 includes first and second indentations 244 and 246, respectively, that are configured to interact with a spring extension 248 extending from a top surface of the mounting bracket 202. When the human interface lever 200 is in the "off" position, the spring extension 248 is positioned so as to extend partly within the first indentation 244, such that the human interface lever will tend to remain in the "off" position until sufficient overcoming force is exerted by an operator to move the human interface lever out of the "off" position. Likewise, when the human interface lever 200 is in the "high-speed" position, the spring extension 248 is positioned so as to extend partly within the second indentation 246, such that the human interface lever will tend to remain in the "high-speed" position until sufficient overcoming force is exerted by an operator to move the human interface lever out of the "high-speed" position. By contrast, when the human interface lever 200 is with an intermediate range of positions between the "off" and "high" speed positions, there is no corresponding indentation in which the spring extension 248 will tend to fit, and correspondingly there is no natural tendency of the human interface lever 200 to remain in any position of that intermediate range of positions.

Turning to FIG. 4, the engine control assembly 102 is shown with the human interface lever 200 further moved to the "choke" position. In this circumstance, even though the human interface lever 200 is positioned farther in the direction indicated by the arrow 210 (again see FIG. 2) than when in the "high-speed" position (as shown in FIG. 3), the intermediate lever 201 remains substantially in the same position in FIG. 4 as it was in FIG. 3 due to a hard stop 249 that is encountered by an additional flange 260 of the intermediate lever 201 when the human interface lever reaches the "high-speed" position (e.g., upon reaching that position due to movement in the direction indicated by the arrow 210 en route from the "off" position). Thus, even though the human interface lever 200 is moved farther away from the governor lever 216 when it is moved from the "high-speed" position of FIG. 3 to the "choke" position of FIG. 4, the governor lever 216 position does not change (or, in at least some alternate embodiments, does not substantially change) as a result of that movement of the human interface lever, and accordingly the actuation of the throttle by way of the throttle actuation input 220 and the throttle actuation spring link 230 does not change as a result of that movement of the human interface lever. It will also be observed from FIG. 4 that, when the human interface lever 200 is moved to the "choke" position, the edge 240 of the triangular extension 242 moves relative to the spring extension 248 so that the spring extension is no longer positioned into the second indentation 246. Correspondingly, although the human interface lever 200 can be moved to the "choke" position, the human interface lever 200 does not naturally tend to remain in that position.

As shown in each of FIGS. 2, 3, and 4, in the present embodiment the human interface lever 200 not only is linked indirectly to the throttle actuation input 220 (by way of the intermediate lever 201, the governor lever 216, the governor spring 226, the additional spring 227, and throttle actuation spring link 230 as discussed above), but also is linked to the choke actuation input 222 by way of a choke linkage 250 that in the present embodiment is a rod that extends between the choke actuation input and an orifice 252 in a downwardly-extending tab 254 formed along the bottom surface of the human interface lever. The orifice 252 is sized to be larger in its cross-section (e.g., the diameter of the orifice) than the cross-section of the choke linkage 250 (e.g., the diameter of the rod), such that the choke linkage 250 can slide back and forth through the orifice without restriction along much of the length of the choke linkage, and particularly can slide back and forth through the orifice without restriction when the human interface lever 200 is moved between the "off" position of FIG. 2 and the "high-speed" position of FIG. 3. Thus, at all times when the human interface lever 200 is moved between the "off" position and the "high-speed" position, movement of the human interface lever does not cause any corresponding movement of the choke actuation input 222 and therefore does not cause any actuation of the choke of the engine 100.

However, further as shown in FIGS. 2, 3, and 4, the choke linkage 250 does include a jog or bend 256 approximately midway along the length of the choke linkage. As a result of the bend 256, although the choke linkage 250 generally is a linear structure, the paths followed by the opposite halves of the choke linkage although parallel with one another are also slightly offset from one another by the length of the bend 256. The bend 256 is particularly formed at a position along the length of the choke linkage 250 such that the bend is in contact with or nearly in contact with the downwardly-extending tab 254 when the human interface lever 200 moves sufficiently in the direction indicated by the arrow 210 that it attains the "high-speed" position. Then, as a result of the bend 256, if the human interface lever 200 is moved further in the direction indicated by the arrow 210 beyond the "high-speed" position and toward the "choke" position, the choke linkage 250 no longer can slide in an unrestricted manner through the orifice 252 of the downwardly-extending tab 254. Rather, during such movement, the tab 254 pushes against the bend 256 and therefore pushes the entire choke linkage 250 in a direction generally away from the governor lever 216 and toward the choke actuation input 222. Consequently, the choke linkage 250 actuates the choke actuation input 222 so as cause actuation of the choke within the carburetor 124, such that the choke becomes closed or substantially closed with the carburetor. In the present embodiment, movement of the choke linkage 250 in this manner, as the human interface lever 200 moves from the "high-speed" position to the "choke" position, causes rotation of the choke actuation input 222 in a counter-clockwise direction as represented by an arrow 258, albeit in other embodiments actuation of the choke can occur due to rotation of the choke actuation input in a clockwise direction (or due to linear or other movements of a choke actuation input).

Although not shown, in the present embodiment, the choke actuation input 222 (or the choke itself) is spring-biased by way of a torsion spring so that, when the human interface lever 200 is moved back from the "choke" position (choke-closed or substantially closed position) to the "high-speed" position (choke-open position), the choke actuation input 222 and the choke linkage 250 move back to the positions shown in FIG. 3. Thus, in the present embodiment in which actuation of the choke actuation input 222 involves rotation in the counter-clockwise direction represented by the arrow 258, the choke actuation input 222 is spring-biased to rotate in the clockwise direction. Accordingly, in addition to the choke of the engine 100 being actuated due to movement of the human interface lever 200 from the "high-speed" position to the "choke" position, the choke of the engine is also deactivated when the human interface lever returns from the "choke" position back to the "high-speed" position.

Further, as already discussed, given the relative sizing of the orifice 252 and the choke linkage 250, further movement of the human interface lever 200 back from the "high-speed" position to the "off" position has no impact upon the choke. Therefore, at least with respect to movement of the human interface lever 200 between the "off" position and the "high-speed" position, the coupling of the human interface lever (and particularly the tab 254 thereof) with the choke actuation input 222 by way of the choke linkage 250 can be considered a "lost motion" coupling arrangement (or connection or linkage), in which movement of the human interface lever 200 does not result in or produce any corresponding movement (or at least does not produce any substantial linear movement) of the choke linkage 250 or the choke actuation input 222 (or the choke) during at least some portions(s) of the range of movement of the human interface lever.

In the present embodiment, the human interface lever 200, intermediate lever 201, mounting bracket 202, and governor lever 216 can be made of stamped steel and at least some of these components can be assembled with respect to one another and/or with respect to other portions of the engine 100 by way of bolts and/or rivets. As already noted above, the human interface lever 200 and intermediate lever 201 in the present embodiment particularly are bolted to the mounting bracket 202 by way of the bolt 206. Nevertheless, in other embodiments, these components and/or other components can be made with other materials and/or assembled by way of other fastening device(s) and/or in other manners.

The present embodiment of the engine control assembly 102 particularly is advantageous as a working assembly that provides an integrated controls system by which a single operator-actuatable control lever (namely, the human interface lever 200) can be used to control each of the throttle (by way of the throttle actuation input 220) and the choke (by way of the choke actuation input 222) of the engine 100, as well as to determine whether the engine is permitted to run or forced to shut off by controlling actuation of the kill switch 218. Thus, by virtue of this arrangement, it is possible to avoid the use of three separate control levers (or other operator-controlled input devices) that respectively are employed to respectively control actuation of the throttle, choke, and kill switch control points of the engine. In particular, by virtue of this arrangement, starting of the engine 100 (particularly during cold starting conditions) is particularly simplified, since engine starting can be achieved by moving the human interface lever 200 from the "off" position to the "choke" position for choking operation while the engine is starting and then subsequently moving to the "high-speed" position once the engine has started and is running. Subsequently, the engine 100 can further be controlled by the operator to cease operation, again through the use of the same single human interface lever 200, when the operator moves that lever to the "off" position so that the kill switch 218 is actuated.

The present disclosure is intended to encompass numerous other embodiments with features differing from one or more of the features of the embodiment shown in FIGS. 1-4. For example, although the present embodiment of FIGS. 1-4 envisions the human interface lever 200 being a control lever that is manually actuated directly by an operator (e.g., the operator's hand directly contacts the second end 208 of the lever), in alternate embodiments the human interface lever can instead be (or be replaced by) a control lever that is actuated indirectly as a result of movement of another input lever (not shown) or other input device (e.g., a rotatable knob or foot pedal) by an operator, where the input lever/device is coupled to the human interface lever 200 (or other corresponding control lever) by way of a Bowden cable or other similar linking device. Further, in some other embodiments, actuations can be provided, at least some of the time, by way of an automatic or mechanical mechanism rather than by a human operator. Also, although in the present embodiment the movements of the human interface lever 200 that cause movements of the governor lever 216 and therefore can effect throttle actuation (e.g., the movements between the "off" position and the "high-speed" position) are different and distinct from the movements of the human interface lever that cause movements of the choke (e.g., the movements between the "high-speed" position and the "choke" position), in other embodiments there can be some movements of the human interface lever that simultaneously effect both throttle actuation and choke operation.

Further, the particular shapes, sizes and configurations of levers and other components shown in FIGS. 1-4 can be modified in numerous manners depending upon the embodiment. Additionally, in some alternate embodiments, the kill switch 218 can not only be a switch that, when actuated, causes the engine 100 to cease operating (e.g., an ignition off switch), but also can be a switch then, when not actuated (or actuated in a reverse manner), causes the engine automatically to be switched on, for example, when the human interface lever 200 moves to a particular position location away from the "off" position in the direction indicated by the arrow 210. Further, notwithstanding the mentioning of a centrifugal governor, in alternate embodiments other types of mechanisms can be employed by which engine speed is translated into feedback that helps to govern engine throttle operation. For example, in some such alternate embodiments, a wind-vein governor or a magnetic force-based governor can be employed in place of a centrifugal governor.

It is specifically intended that the present disclosure not be limited to the embodiments and illustrations contained herein, but include modified forms of those embodiments including portions of the embodiments and combinations of elements of different embodiments as come within the scope of the following claims.

We claim:

1. An engine control assembly for use with an internal combustion engine, the engine control assembly comprising:

a mounting structure;

a first lever structure that is coupled to the mounting structure and configured to rotate about a first axis to any of a plurality of positions ranging from a first position to a second position in response to input forces being applied thereto;

a switch device positioned in relation to the first lever structure, the switch device configured to cause the engine to stop running when the first lever structure is in the first position so as to impart a further force at least indirectly to an input of the switch device;

at least one first linking structure coupled to the first lever structure and configured to allow first rotational movement of the first lever structure to influence at least indirectly an engine throttle operation; and at least one second linking structure coupled to the first lever structure and configured to allow second rotational movement of the first lever structure to influence at least indirectly an engine choking operation, wherein the engine choking operation occurs at least when the first lever structure is at the second position;

wherein the at least one second linking structure includes a rod that extends between the first lever structure and a choke actuation input structure, wherein the rod includes at least one bend portion along a length of the rod, wherein at least one portion of the first lever structure includes a formation with an orifice through which the rod extends, wherein the formation is in contact with the at least one bend portion when the first lever structure undergoes the second rotational movement, so that at least some substantially linear movement is imparted to the rod that in turn causes at least some associated movement of the choke actuation input structure resulting in the engine choking operation, and wherein the rod and the formation are configured so that the first rotational movement of the first lever structure does not cause any corresponding movement of the choke actuation input structure.

2. The engine control assembly of claim 1, wherein the at least one second linking structure and the first lever structure are configured as a lost motion coupling arrangement so that the first rotational movement of the first lever structure does not cause any corresponding movement of the choke actuation input structure to which the at least one second linking structure is coupled.

3. The engine control assembly of claim 1, wherein the at least one first linking structure includes a governor lever structure.

4. The engine control assembly of claim 3, wherein the at least one first linking structure further includes an additional lever structure.

5. The engine control assembly of claim 4, wherein the at least one first linking structure also includes a first link between the first lever structure and the additional lever structure, a second link between the additional lever structure and the governor lever structure, and a third link extending between the governor lever structure and a throttle actuation input structure.

6. The engine control assembly of claim 5, wherein the first link includes a first spring, the second link includes a second spring, and the third link includes a third spring, wherein the governor lever structure further is at least indirectly connected to a centrifugal governor, and wherein the engine control assembly further includes a stop that is encountered by the additional lever structure when the first lever structure attains an intermediate position between the first and second positions such that the second rotational movement does not result in any corresponding movement of the additional lever structure or any corresponding engine throttle actuation change.

7. The engine control assembly of claim 4 wherein the additional lever structure is also configured to rotate about the first axis about which the first lever structure is configured to rotate.

8. The engine control assembly of claim 7, wherein the first lever structure and the additional lever structure are configured so that the additional lever structure contacts the input of the switching device when the first lever structure is in the first position, whereby the additional lever structure imparts the further force to the input of the switching device.

9. The engine control assembly of claim 1, wherein the first rotational movement includes any of a plurality of first rotations of the first lever structure between any two of a plurality of first locations including or between the first position and an intermediate position, wherein the intermediate position is between the first position and the second position, wherein the second rotational movement includes any of a plurality of second rotations of the first lever structure between any two of a plurality of second locations including or between the second position and the intermediate position, and wherein the engine control assembly is configured so that the first rotational movement of the first lever structure has no effect or substantially no effect upon the engine choking operation and the second rotational movement of the first lever structure has no effect or substantially no effect upon the engine throttle operation.

10. The internal combustion engine comprising the engine control assembly of claim 1, and further comprising a choke actuated at least indirectly by way of the at least one second linking structure and a throttle actuated at least indirectly by way of the at least one first linking structure.

11. An engine control assembly for use with an internal combustion engine, the engine control assembly comprising:

a mounting structure;

a first lever that is configured to receive input forces at least indirectly received from an operator and capable of attaining a range of positions including and between a first position and a second position;

a second lever, a third lever that is at least indirectly linked to a throttle actuation input structure, and at least one linkage coupling the first lever to a choke actuation input structure;

wherein the first lever is rotatably coupled to the mounting structure, and the second lever is at least indirectly coupled to each of the first lever and the third lever, wherein the engine control assembly is configured so that first movements of the first lever between the first position and an intermediate position between the first and second positions in response to the input forces can at least indirectly affect the throttle actuation input structure, wherein the at least one linkage is configured so that the first movements of the first lever do not affect a positioning of the choke actuation input structure but second movements of the first lever between the intermediate position and the second position do affect the positioning of the choke actuation input structure, and wherein the at least one linkage includes a rod having at least one bend portion along a length of the rod, wherein the first lever includes a formation with an orifice through which the rod extends, and wherein the formation is in contact with the at least one bend portion when the first lever undergoes the second movements, so that at least some substantially linear movement is imparted to the rod that in turn causes at least one associated movement of the choke actuation input structure resulting in an engine choking operation.

12. The engine control assembly of claim 11, wherein the first lever is connected to the second lever by way of a first spring such that at least some of the first movements by the first lever cause corresponding movements of the second lever.

13. The engine control assembly of claim 12, further comprising a stop that is encountered by the second lever when the first lever reaches the intermediate position, wherein due to the stop further movements of the second lever do not occur when the first lever is undergoing the second movements.

14. The engine control assembly of claim 13, wherein the second lever is coupled to the third lever at least in part by way of a governor spring.

15. The engine control assembly of claim 14, wherein an additional position of the third lever is influenced by each of a first tension applied by the governor spring, and a force imparted at least indirectly upon the third lever from a centrifugal governor.

16. The engine control assembly of claim 15, wherein each of the first and second levers is rotatably coupled to the mounting structure by a shared fastening structure, and the first and second levers are configured for rotation about a common axis.

17. The engine control assembly of claim 16, wherein the second lever is forced by the first lever into contact with an input of a switching device when the first lever is actuated to attain the first position and, as a result, the switching device causes a cessation of an engine operation.

18. A method of operating an internal combustion engine, the method comprising:

providing an engine control assembly including a first lever structure, a mounting structure, and at least one link structure at least indirectly coupling the first lever structure to a choke actuation input structure, the first lever structure being rotatably coupled to the mounting structure and configured for attaining any of a plurality of positions including and between a first position and a second position;

first rotating the first lever structure at least from an intermediate position between the first and second positions to the second position, wherein the first rotating results in an actuation force being communicated from the first lever structure to the choke actuation input structure by way of the at least one link structure so that, upon the first lever structure reaching the second position, a choke of the engine is in a substantially closed position;

second rotating the first lever structure back from the second position to a further position that is either at the intermediate position or in between the intermediate position and the first position so that a choking operation of the engine substantially ceases;

operating the engine at a throttle setting determined at least in part by the further position of the first lever structure; and third rotating the first lever structure to the first position so that, at least indirectly, a force is communicated from the first lever structure to an input of a switching device and, as a result, the engine is switched to an off status, wherein the at least one link structure includes a rod with a bend portion and the first lever structure includes a formation with an orifice through which the rod extends, wherein during the first rotating the formation imparts the actuation force upon the bend portion and the actuation force in turn is communicated to the choke actuation input structure by way of the rod, and wherein during a rotational movement of the first lever structure between the intermediate and first positions, the formation is no longer in contact with the bend portion and correspondingly the rotational movement of the first lever structure between the intermediate and first positions has no effect on the choking operation of the engine.

19. The method of claim 18, wherein the rotational movement of the first lever structure between the intermediate and first positions causes at least one additional rotational movement of an intermediate lever structure that in turn causes at least some further rotational movement of a governor lever that influences the throttle setting, but the first rotating of the first lever structure from the intermediate position to the second position does not cause any other rotational movement of the intermediate lever structure and therefore does not cause any additional change to the throttle setting.

20. The method of claim 18, wherein control of each of the choking operation, throttle setting, and off status of the engine is possible by way of actuating the first lever structure.

* * * * *